US010670992B2

(12) United States Patent
Sakai

(10) Patent No.: US 10,670,992 B2
(45) Date of Patent: Jun. 2, 2020

(54) DEVELOPER CONTAINER AND IMAGE FORMING APPARATUS

(71) Applicant: FUJI XEROX CO., LTD., Tokyo (JP)

(72) Inventor: Kazuhiko Sakai, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/296,222

(22) Filed: Mar. 8, 2019

(65) Prior Publication Data

US 2020/0073282 A1 Mar. 5, 2020

(30) Foreign Application Priority Data

Sep. 3, 2018 (JP) ..... 2018-164510

(51) Int. Cl.
*G03G 15/08* (2006.01)
*G03G 21/16* (2006.01)

(52) U.S. Cl.
CPC ..... *G03G 15/0889* (2013.01); *G03G 15/0867* (2013.01); *G03G 21/1647* (2013.01)

(58) Field of Classification Search
CPC ..... G03G 15/0893; G03G 15/0891; G03G 15/0889; G03G 15/0865; G03G 15/0877
USPC ..... 399/254
See application file for complete search history.

(56) References Cited

U.S. PATENT DOCUMENTS

2016/0091825 A1* 3/2016 Oba ..... G03G 15/0872 399/254
2016/0274493 A1* 9/2016 Horii ..... G03G 15/0872

FOREIGN PATENT DOCUMENTS

| | | | | |
|---|---|---|---|---|
| JP | 10-171230 | | 6/1998 | |
| JP | 2001-025678 A | * | 1/2001 | |
| JP | 2008-164663 A | * | 7/2008 | ..... G03G 15/08 |
| JP | 2008164663 | | 7/2008 | |
| JP | 2011-150121 | | 8/2011 | |

* cited by examiner

*Primary Examiner* — Walter L Lindsay, Jr.
*Assistant Examiner* — Frederick Wenderoth
(74) *Attorney, Agent, or Firm* — JCIPRNET

(57) ABSTRACT

A developer container includes a containing device, a support member, and a crumbling device. The containing device contains developer therein and is rotated so as to transport the developer. The support member supports the containing device such that the containing device is rotatable. The support member has an outlet through which the developer transported by the containing device flows out. The crumbling device is supported such that the crumbling device is rotatable together with the containing device. The crumbling device is, when the containing device is rotated, rotated so as to crumble the developer. The crumbling device includes a body portion and an applying member. The body portion extends from a region near the containing device toward the outlet. The applying member is formed in the body portion. The applying member applies a force for transporting the developer toward the outlet when the crumbling device is rotated.

9 Claims, 9 Drawing Sheets

DEVELOPER CONTAINER AND IMAGE FORMING APPARATUS

CROSS-REFERENCE TO RELATED APPLICATIONS

This application is based on and claims priority under 35 USC 119 from Japanese Patent Application No. 2018-164510 filed Sep. 3, 2018.

BACKGROUND

(i) Technical Field

The present disclosure relates to a developer container and an image forming apparatus.

(i) Technical Field

Examples of known related-art developer containing devices containing the developer in related-art image forming apparatuses such as copiers or printers include Japanese Unexamined Patent Application Publication No. 2008-164663.

In Japanese Unexamined Patent Application Publication No. 2008-164663 (paragraphs [0032] to [0035], FIG. 4), a technique is described in which a transport member (3) disposed in a container body (1A) is rotated together with the container body (1A) such that inclined surface-shaped guide portions (3a) of the transport member (3) transport developer to an opening (1a).

In Japanese Unexamined Patent Application Publication No. 10-171230 (paragraphs [0008] to [0011], FIGS. 1 and 2), a structure is described in which a helical rib (2b) is disposed in a bottle mouth portion (1a) at a distal end of a rotatable toner bottle (1), and toner transported by rotation of the toner bottle (1) is fed out by rotation of the helical rib (2b) separately driven from the toner bottle (1).

In Japanese Unexamined Patent Application Publication No. 2011-150121 (paragraphs [0029] to [0039], FIGS. 3 and 4), a technique is described in which a suction nozzle (11) is supported at an end portion of a rotatable toner bottle (1), and toner is discharged from the toner bottle (1) by sucking with a suction pump (30).

SUMMARY

Aspects of non-limiting embodiments of the present disclosure relate to suppression of complication of the structure compared to the case where a member transporting developer toward an outlet is separately provided from a member agitating the developer in a developer container in which a developer containing portion is rotated.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a developer container including a containing device, a support member, and a crumbling device. The containing device contains developer therein and is rotated so as to transport the developer. The support member supports the containing device such that the containing device is rotatable. The support member has an outlet through which the developer transported by the containing device flows out. The crumbling device is supported such that the crumbling device is rotatable together with the containing device. The crumbling device is, when the containing device is rotated, rotated so as to crumble the developer. The crumbling device includes a body portion and an applying member. The body portion extends from a region near the containing device toward the outlet. The applying member is formed in the body portion. The applying member applies a force for transporting the developer toward the outlet when the crumbling device is rotated.

BRIEF DESCRIPTION OF THE DRAWINGS

Exemplary embodiment of the present disclosure will be described in detail based on the following figures, wherein:

FIG. 4A is a side view of the toner cartridge and FIG. 4B illustrates the toner cartridge seen in an arrow IVB direction illustrated in FIG. 4A;

FIG. 5A is a sectional view of the toner cartridge taken along line VA-VA illustrated in FIG. 4B and FIG. 5B is a sectional view of the toner cartridge taken along line VB-VB illustrated in FIG. 4B;

DETAILED DESCRIPTION

Figure 1:
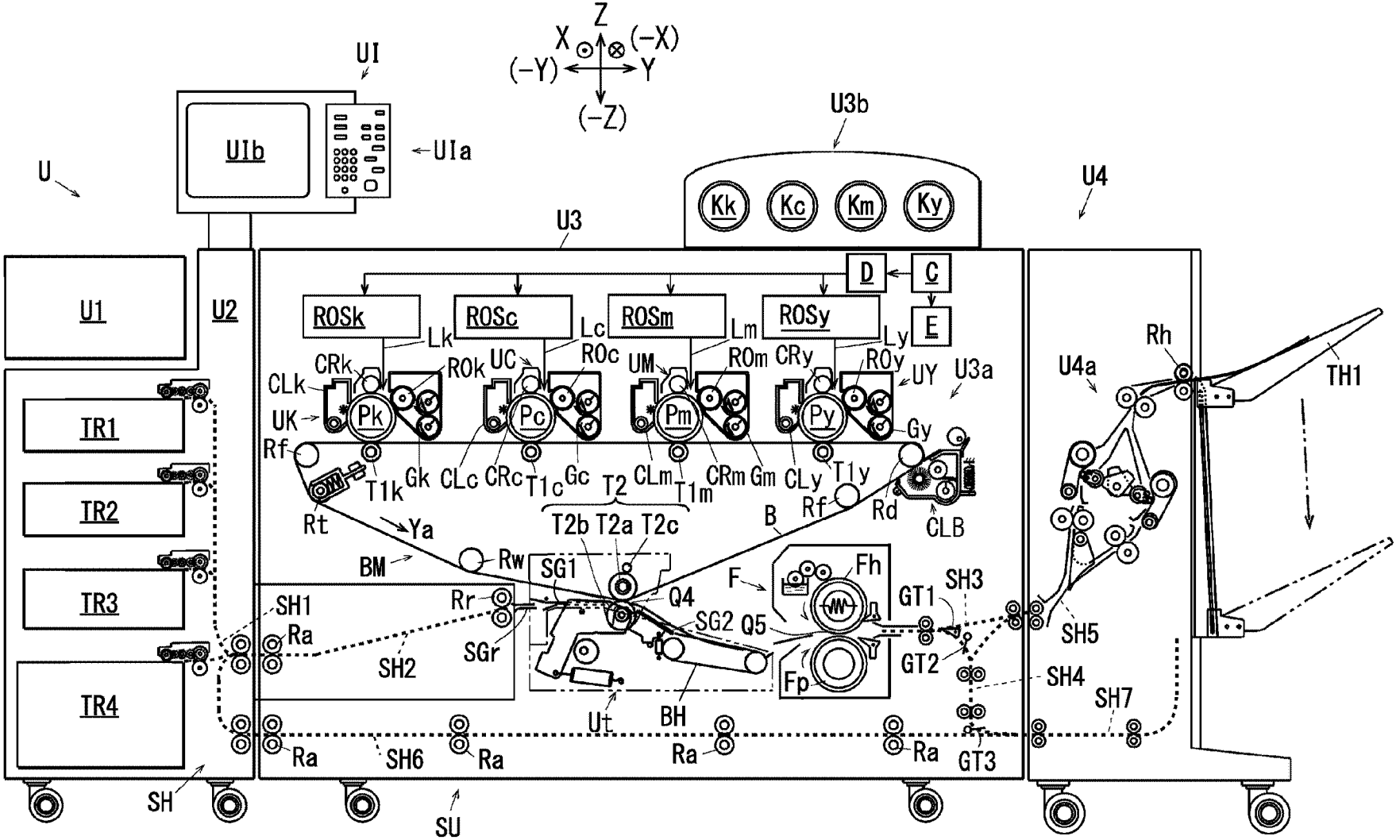
FIG. 1 illustrates a general view of an image forming apparatus according to a first example.

Next, a specific example of an exemplary embodiment of the present disclosure (referred to as "example" hereafter) will be described with reference to the drawings. However, the present disclosure is not limited to the following example.

For ease of understanding of the following description, directions and sides are defined as follows in the drawings: the front-rear direction is the X direction, the left-right direction is the Y direction, and the up-down direction is the Z direction; and the directions or sides indicated by arrows X, −X, Y, −Y, Z, and −Z are respectively the front, rear, right, left, upper, and lower directions or sides.

Also, a circle marked with a dot therein and a circle marked with an "x" therein illustrated in the pages of the drawings respectively indicate an arrow extending from the back side to the front side of the page and an arrow extending from the front side to the back side of the page.

It should also be noted that, in the following description with reference to the drawings, elements other than those required for the description are omitted from the drawings as appropriate for ease of understanding.

First Example

FIG. 1 illustrates a general view of an image forming apparatus according to a first example.

Figure 2:
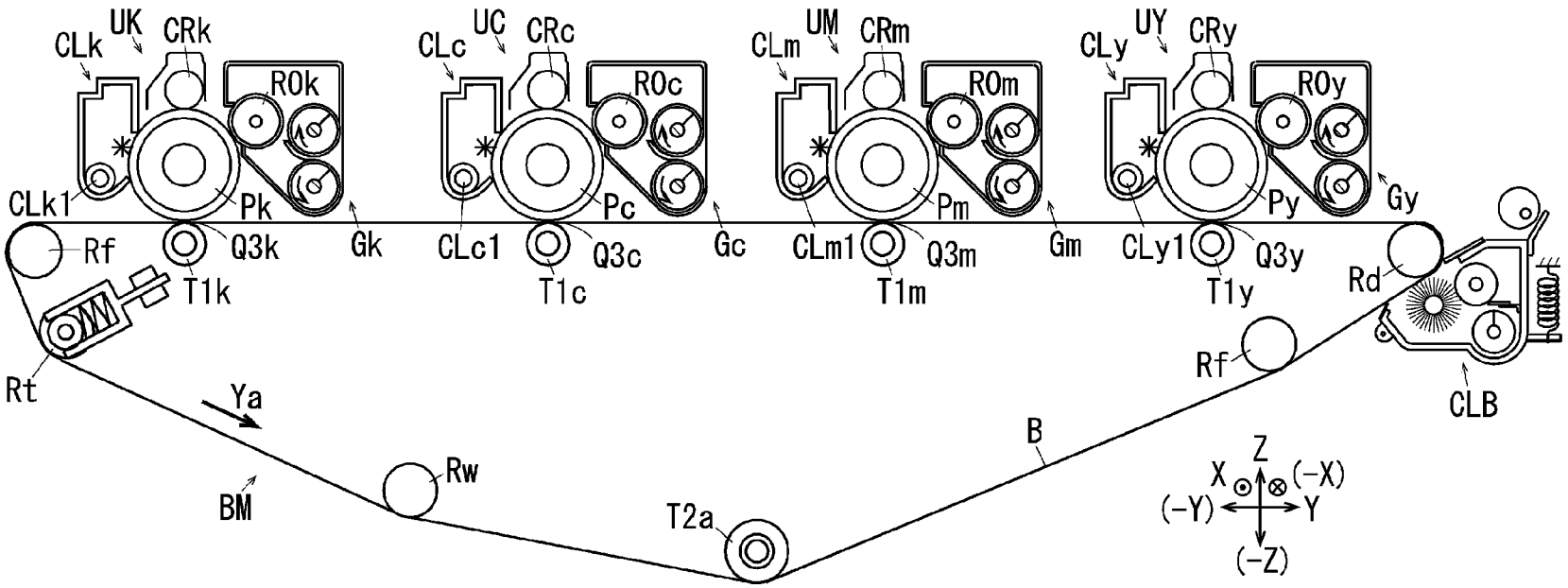
FIG. 2 is an enlarged view illustrating visible image forming devices according to the first example.

FIG. 2 is an enlarged view illustrating visible image forming devices according to the first example.

Referring to FIG. 1, a copier U, which exemplifies the image forming apparatus, includes an operating section UI, a scanner section U1, a feeder system U2, an image forming system U3, and a medium processing device U4. The scanner section U1 exemplifies an image reader, the feeder system U2 exemplifies a medium feed device, and the image forming system U3 exemplifies an image recording device.

Description of the Operating Section UI

The operating section UI includes input buttons UIa used for, for example, starting of copying and setting of the number of copies. The operating section UI also includes a display UIb in which content input with the input buttons UIa and a state of the copier U are displayed.

Description of the Feeder System U2

Referring to FIG. 1, the feeder system U2 includes a plurality of sheet feed trays TR1, TR2, TR3, TR4. The sheet feed trays TR1 to TR4 each exemplify a medium containing device. Furthermore, the feeder system U2 has a medium supply path SH1 and the like. Sheets of recording paper S contained in the sheet feed trays TR1 to TR4 are fed from the sheet feed trays TR1 to TR4 and transported to the image forming system U3 through the medium supply path SH1 and the like. The recording sheets S each exemplify a medium for image recording.

Description of the Image Forming System U3 and the Medium Processing Device U4

Referring to FIG. 1, the image forming system U3 includes an image recording section U3*a*. The image recording section U3*a* performs image recording based on original images read by the scanner section U1 on the recording sheets S transported from the feeder system U2.

Referring to FIGS. 1 and 2, a drive circuit D for latent image forming units of the image forming system U3 outputs to latent image forming devices ROSy, ROSm, ROSc, ROSk for colors Y to K at predetermined timing driving signals that are based on image information input from the scanner section U1 and correspond to the image information. Photoconductor drums Py, Pm, Pc, Pk are disposed below the latent image forming devices ROSy to ROSk. The photoconductor drums Py, Pm, Pc, Pk each exemplify an image holding device.

Charging rollers CRy, CRm, CRc, CRk charge the surfaces of the photoconductor drums Py, Pm, Pc, Pk being rotated. The charging rollers CRy, CRm, CRc, CRk each exemplify a charger. Electrostatic latent images are formed on the charged surfaces of the photoconductor drums Py, Pm, Pc, Pk by laser beams Ly, Lm, Lc, Lk emitted by the latent image forming devices ROSy, ROSm, ROSc, ROSk. The latent image forming devices ROSy, ROSm, ROSc, ROSk each exemplify a latent image forming unit. The laser beams Ly, Lm, Lc, Lk each exemplify latent image drawing light. Developing devices Gy, Gm, Gc, Gk develop the electrostatic latent images on the surfaces of the photoconductor drums Py, Pm, Pc, Pk into toner images of yellow Y, magenta M, cyan C, and black K. The developing devices Gy, Gm, Gc, Gk each exemplify a developing unit, and the toner images each exemplify a visible image.

The developing devices Gy to Gk, which consumes developer for developing, are replenished with the developer from toner cartridges Ky, Km, Kc, Kk. The toner cartridges Ky, Km, Kc, Kk each exemplify a developer container. The toner cartridges Ky, Km, Kc, Kk are removably mounted in a developer replenishment device U3*b*.

First transfer rollers T1*y*, T1*m*, T1*c*, T1*k* transfer the toner images on the surfaces of the photoconductor drums Py, Pm, Pc, Pk onto an intermediate transfer belt B such that the toner images are sequentially superposed in first transfer regions Q3*y*, Q3*m*, Q3*c*, Q3*k* on the intermediate transfer belt B so as to form a color toner image on the intermediate transfer belt B. The first transfer rollers T1*y* to T1*k* each exemplify a first transfer device, the intermediate transfer belt B exemplifies an image holding device and an intermediate transfer device, and the color toner image exemplifies a multi-color visible image. The color toner image formed on the intermediate transfer belt B is transported to a second transfer region Q4.

In the case where only the image information of the K color is input, only the photoconductor drum Pk and the developing device Gk for the K color are used to form a toner image of the K color.

Drum cleaners CLy, CLm, CLc, CLk remove residual matter such as the developer or paper dust attracted to the surfaces of the photoconductor drums Py, Pm, Pc, Pk having undergone first transfer. The drum cleaners CLy, CLm, CLc, CLk each exemplify a cleaning device.

According to the first example, the photoconductor drum Pk, the charging roller CRk, and the drum cleaner CLk are integrated with one another as a photoconductor unit UK for the K color. The photoconductor unit UK exemplifies an image holding body unit. Also for the other colors Y, M, C, similarly to the photoconductor unit UK, photoconductor units UY, UM, UC respectively include the photoconductor drums Py, Pm, Pc, the charging rollers CRy, CRm, CRc, and the drum cleaners CLy, CLm, CLc.

Furthermore, a visible image forming device UK+Gk for the K color includes the photoconductor unit UK for the K color and the developing device Gk including a developing roller R0*k*. The developing roller R0*k* exemplifies a developer holding device. Likewise, visible image forming devices UY+Gy, UM+Gm, UC+Gc for the Y, M, C colors respectively include the photoconductor units UY, UM, UC for the Y, M, C colors and the developing devices Gy, Gm, Gc including developing rollers R0*y*, R0*m*, R0*c* for the Y, M, C colors. Although the visible image forming devices UY+Gy to UK+Gk form visible images with the developer of Y, M, C, K according to the first example, a transparent image (invisible image) is able to be formed with transparent toner.

A belt module BM is disposed below the photoconductor drums Py to Pk. The belt module BM exemplifies an intermediate transfer unit. The belt module BM includes the intermediate transfer belt B, a drive roller Rd, a tension roller Rt, a walking roller Rw, a plurality of idle rollers Rf, a backup roller T2*a*, and the first transfer rollers T1*y*, T1*m*, T1*c*, T1*k*. The drive roller Rd exemplifies a drive device for an intermediate transfer body. The tension roller Rt exemplifies a tension applying device. The walking roller Rw exemplifies a walking suppressing device. The idle rollers Rf each exemplify a driven device. The backup roller T2*a* exemplifies a facing device. The intermediate transfer belt B is supported such that the intermediate transfer belt B is rotatable in an arrow Ya direction.

A second transfer unit Ut is disposed below the backup roller T2*a*. The second transfer unit Ut includes a second transfer roller T2*b*. The second transfer roller T2*b* exemplifies a second transfer member. The second transfer region Q4 is defined by a region where the second transfer roller T2*b* is in contact with the intermediate transfer belt B. Furthermore, the backup roller T2*a* faces the second transfer roller T2*b* with the intermediate transfer belt B interposed therebetween. A contact roller T2*c* is in contact with the backup roller T2*a*. The contact roller T2*c* exemplifies a power feed device. A second transfer voltage the polarity of which is the same as the polarity to which the toner is charged is applied to the contact roller T2*c*.

The second transfer section T2 includes the backup roller T2*a*, the second transfer roller T2*b*, and the contact roller T2*c*. The second transfer section T2 exemplifies a second transfer device.

A medium transport path SH2 is disposed below the belt module BM. Each of the recording sheets S supplied from the medium supply path SH1 of the feeder system U2 is transported to a registration roller Rr by a transport roller Ra. The transport roller Ra exemplifies a medium transport device, and the registration roller Rr exemplifies a transport timing adjusting device. The registration roller Rr transports the recording sheet S downstream in the direction in which the sheet is transported. The registration roller Rr transports the sheet S at timing adjusted to timing at which the toner image formed on the intermediate transfer belt B is transported to the second transfer region Q4. The recording sheet S fed by the registration roller Rr is guided by a registration sheet guide SGr and a pretransfer sheet guide SG1 so as to be transported to the second transfer region Q4.

The second transfer section T2 transfers the toner image on the intermediate transfer belt B onto the recording sheet S while the toner image is passing through the second transfer region Q4. In the case of the color toner image, the toner images transferred onto the surface of the intermediate transfer belt B so as to be superposed on one another through first transfer are collectively transferred onto the recording sheet S through second transfer.

A transfer system T1*y* to T1*k*+T2+B according to the first example includes, for example, the first transfer rollers T1*y* to T1*k*, the second transfer section T2, and the intermediate transfer belt B.

The intermediate transfer belt B having undergone the second transfer is cleaned by a belt cleaner CLB disposed downstream of the second transfer region Q4 in the direction in which the intermediate transfer belt B is rotated. The belt cleaner CLB exemplifies a cleaner. The belt cleaner CLB removes residual matter such as the developer remaining on the intermediate transfer belt B without being transferred in the second transfer region Q4 or paper dust from the intermediate transfer, belt B.

The recording sheet S onto which the toner image has been transferred is guided by a posttransfer sheet guide SG2 so as to be fed to a medium transport belt BH. The medium transport belt BH exemplifies a medium transport device. The medium transport belt BH transports the recording sheet S to a fixing device F. The fixing device F exemplifies a fixing unit.

The fixing device F includes a heating roller Fh that exemplifies a heating device and a pressure roller Fp. The pressure roller Fp exemplifies a pressure applying device. The recording sheet S is transported to a fixing region Q5 where the heating roller Fh and the pressure roller Fp are in contact with each other. The toner image on the recording sheet S is subjected to heat and pressure applied by the fixing device F while passing through the fixing region Q5, thereby being fixed.

The image recording section U3*a* according to the first example includes the visible image forming devices UY+Gy to UK+Gk, the transfer system T1*y* to T1*k*+T2+B, and the fixing device F.

A switching gate GT1 is provided downstream of the fixing device F in the recording sheet S transport direction. The switching gate GT1 exemplifies a switching device. The switching gate GT1 selectively switches the destination of the recording sheet S having passed through the fixing region Q5 between an output path SH3 for the medium processing device U4 or an inversion path SH4. The recording sheet S transported to the output path SH3 is transported to a sheet transport path SH5 of the medium processing device U4. A decurler U4*a* is disposed in the sheet transport path SH5. The decurler U4*a* exemplifies a warpage correcting member. The decurler U4*a* corrects warpage, that is, so-called curling of the transported recording sheet S. The decurled recording sheet S is output by an output roller Rh to a receiving tray TH1 with an image fixed side of the sheet facing upward. The output roller Rh exemplifies a medium output member, and the receiving tray TH1 exemplifies a medium receiving device.

The recording sheet S directed toward the inversion path SH4 of the image forming system U3 by the switching gate GT1 is transported to the inversion path SH4 of the image forming system U3 through a second gate GT2. The second gate GT2 exemplifies a switching device.

At this time, in order to output the recording sheet S with the image fixed side facing downward, the transport direction of the recording sheet S is reversed after the trailing end of the recording sheet S in the transport direction of the recording sheet S has passed through the second gate GT2. Here, the second gate GT2 according to the first example is formed by a thin film-shaped elastic member. Accordingly, the second gate GT2 allows the recording sheet S having been transported to the inversion path SH4 to pass through the second gate GT2 once without changing a state of the recording sheet S and, when the recording sheet S having passed through the second gate GT2 is reversed, that is, switched back, guides this switched back recording sheet S toward the transport paths SH3, SH5. Then, the switched back recording sheet S passes through the decurler U4*a* and is output to the receiving tray TH1 with the image fixed side facing downward.

A circulation path SH6 is connected to the inversion path SH4 of the image forming system U3. A third gate GT3 is disposed in a portion where the circulation path SH6 is connected to the inversion path SH4. The third gate GT3 exemplifies a switching device. Furthermore, the downstream end of the inversion path SH4 in the transport direction of the recording sheet S is connected to an inversion path SH7 of the medium processing device U4.

The recording sheet S having passed through the switching gate GT1 and been transported to the inversion path SH4 is directed toward the inversion path SH7 of the medium processing device U4 by the third gate GT3. Similarly to the second gate GT2, the third gate GT3 according to the first example is formed by a thin film-shaped elastic member. Accordingly, the third gate GT3 allows the recording sheet S having been transported through the inversion path SH4 to pass through the third gate GT3 once and, when the recording sheet S having passed through the third gate GT3 is switched back, guides this switched back recording sheet S toward the circulation path SH6.

The recording sheet S having been transported to the circulation path SH6 is fed to the second transfer region Q4 again through the medium transport path SH2. Thus, printing is performed on a second side of the recording sheet S.

The elements denoted by the signs SH1 to SH7 are included in a sheet transport path SH. Furthermore, the elements denoted by the signs SH, Ra, Rr, Rh, SGr, SG1, SG2, BH, and GT1 to GT3 are included in a sheet transport device SU according to the first example.

Description of the Toner Cartridges

Figure 3:
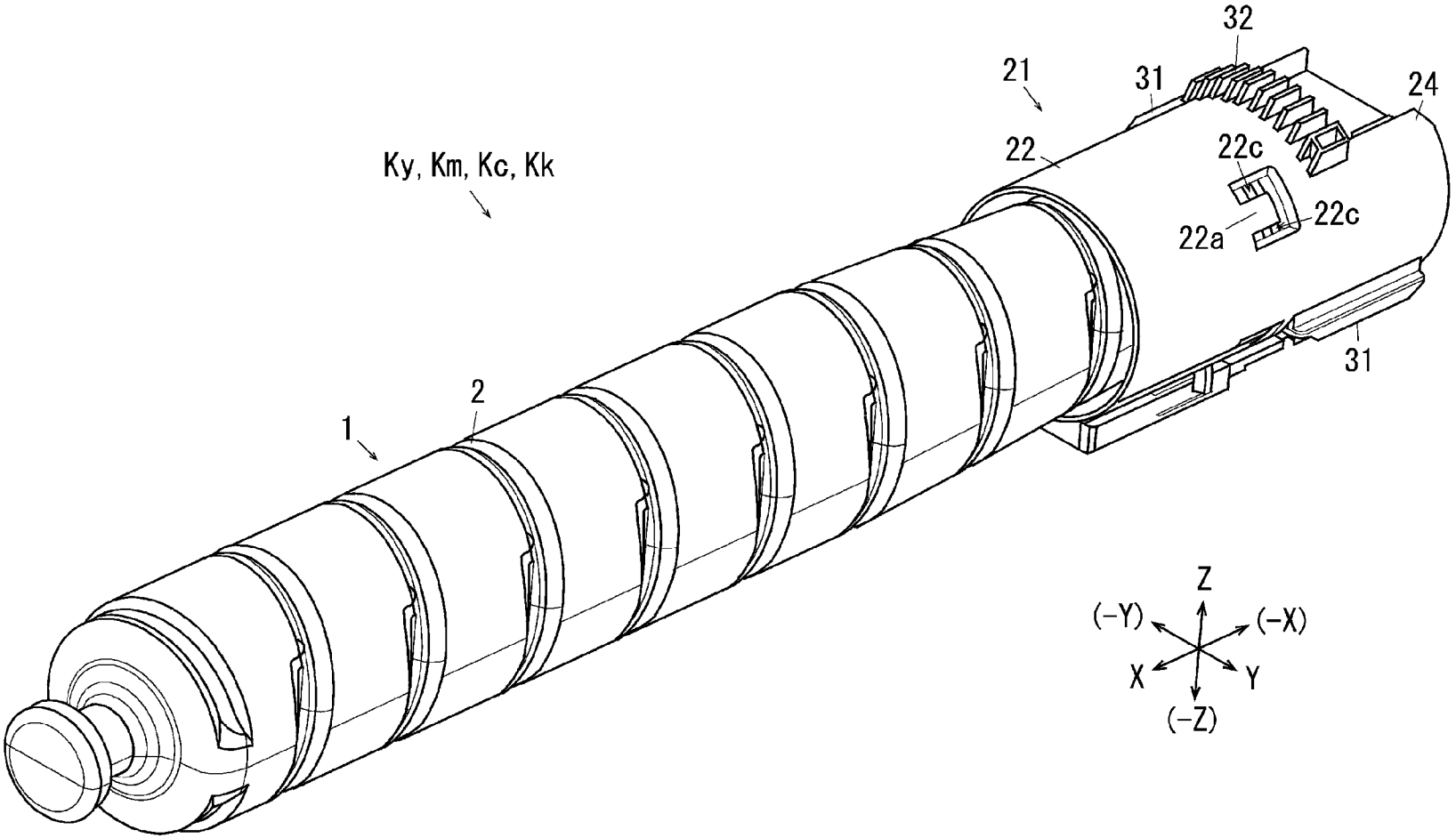
FIG. 3 is a perspective view of a toner cartridge according to the first example.

FIG. 3 is a perspective view of one of the toner cartridges according to the first example.

Figure 4B:
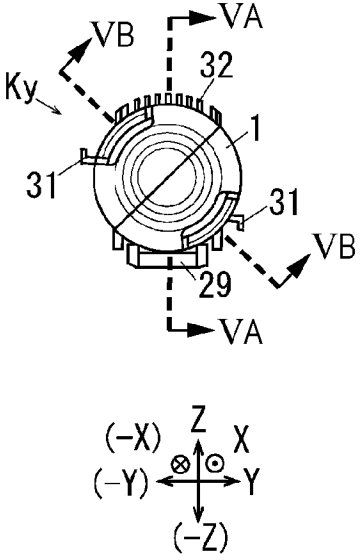
FIGS. 4A and 4B illustrate the toner cartridge according to the first example, and, out of FIGS. 4A and 4B.
Figure 4A:
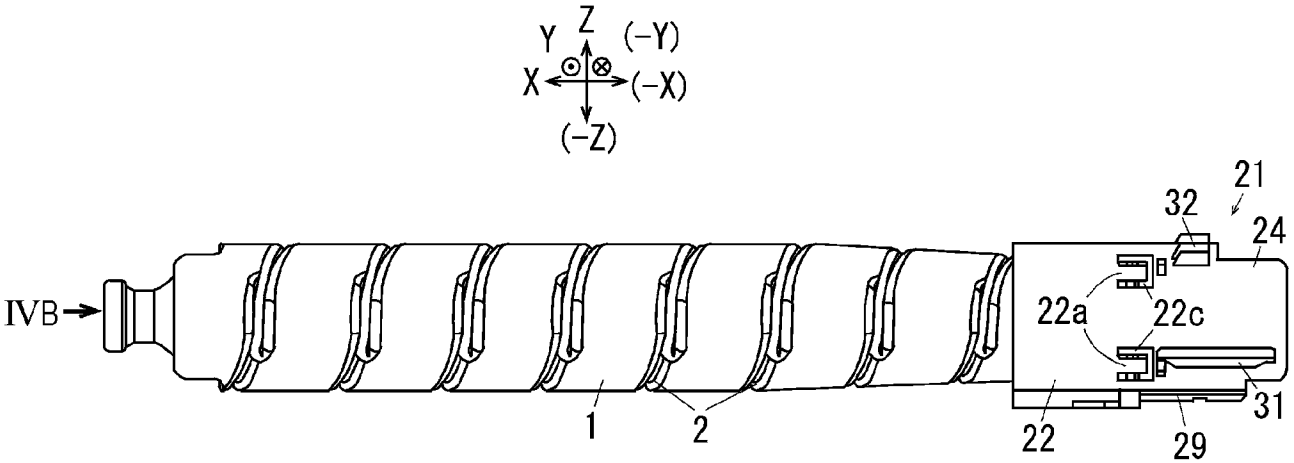

FIGS. 4A and 4B illustrate the toner cartridge according to the first example, and, out of FIGS. 4A and 4B, FIG. 4A is a side view of the toner cartridge and FIG. 4B illustrates the toner cartridge seen in an arrow IVB direction illustrated in FIG. 4A.

Figure 5A:
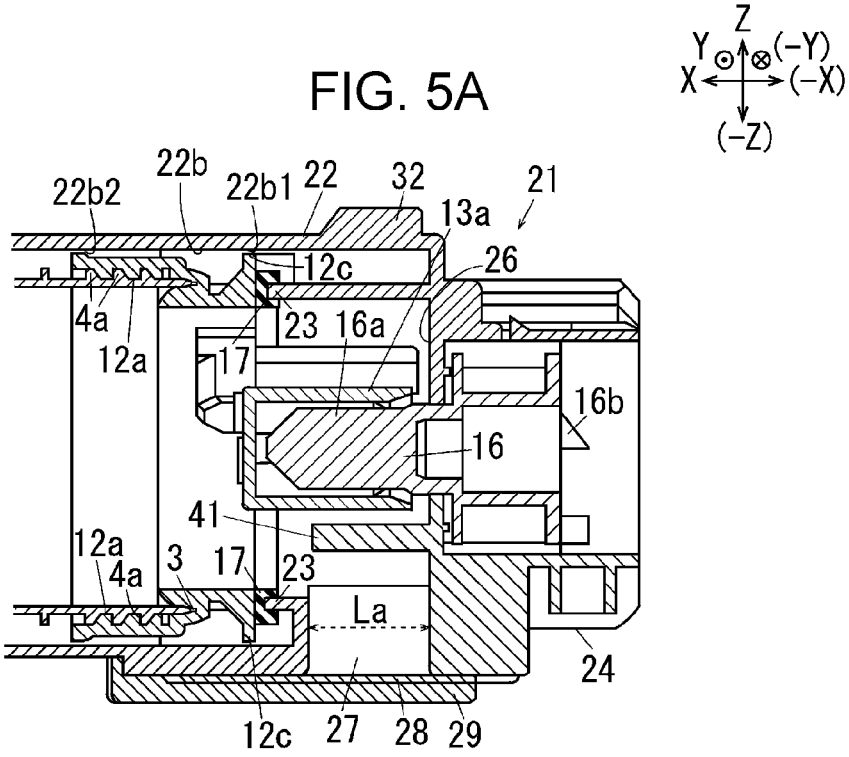
FIGS. 5A and 5B are sectional views of part of the toner cartridge according to the first example, and, out of FIGS. 5A and 5B.
Figure 5B:
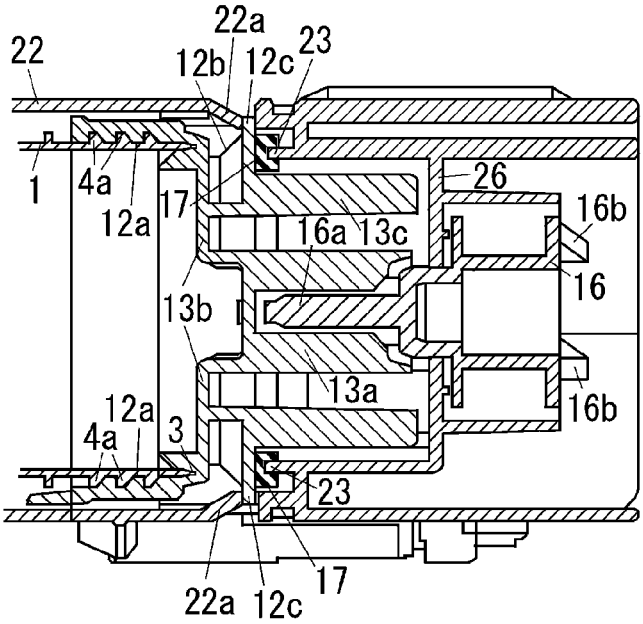

FIGS. 5A and 5B are sectional views of part of the toner cartridge according to the first example, and, out of FIGS. 5A and 5B, FIG. 5A is a sectional view of the toner cartridge taken along line VA-VA illustrated in FIG. 4B and FIG. 5B is a sectional view of the toner cartridge taken along line VB-VB illustrated in FIG. 4B.

Referring to FIGS. 3, 4A, and 4B, the toner cartridges Ky to Kk according to the first example each include a bottle 1. The bottle 1 exemplifies a body of a containing portion. The bottle 1 has a cylindrical shape extending in the front-rear direction and allows the developer to be contained therein. A helical groove 2 that exemplifies a developer transport portion is formed in a wall surface of the bottle 1. The groove 2 exemplifies a developer transport portion. A helical ridge is formed inside the bottle 1 by the groove 2. Referring to FIGS. 5A and 5B, an opening 3 is formed at the rear end of the bottle 1. A screw portion 4*a* is formed at a position in front of the opening 3 in an outer surface of the bottle 1. The screw portion 4*a* exemplifies a fastening portion.

Figure 6:
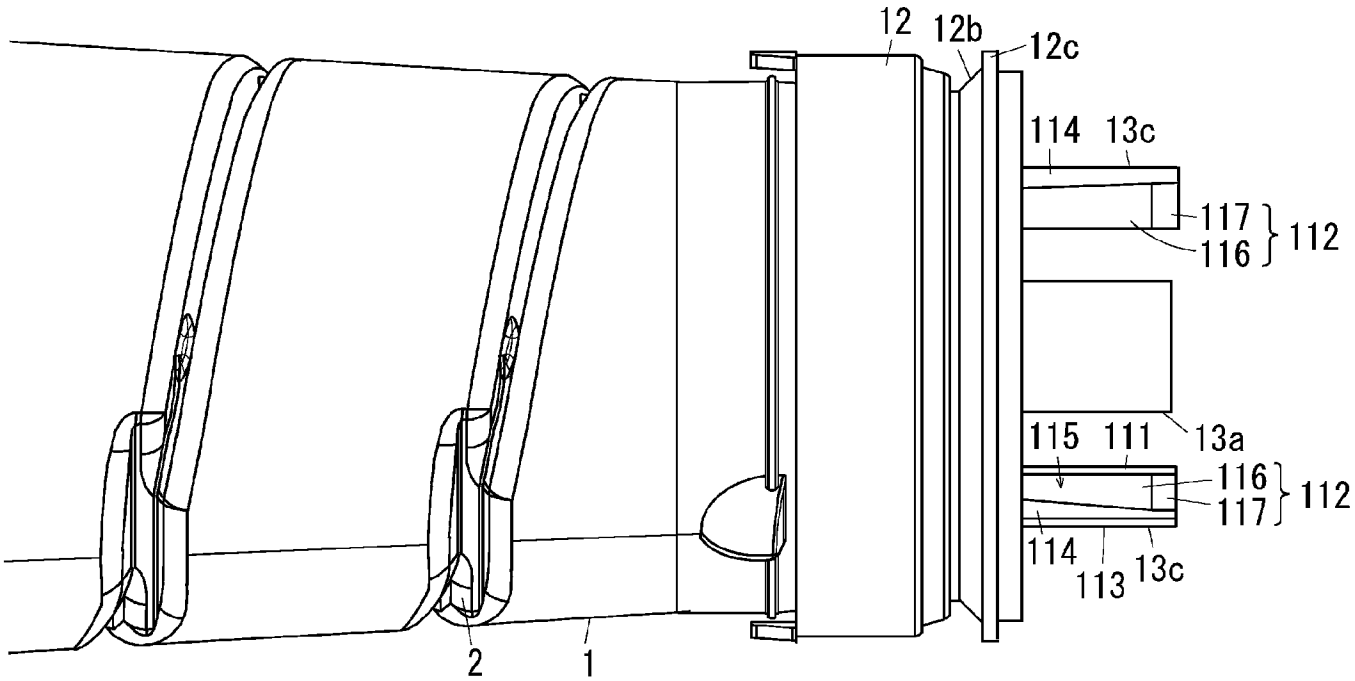
FIG. 6 illustrates the toner cartridge according to the first example with a flange portion removed.

FIG. 6 illustrates the toner cartridge according to the first example with a flange portion removed.

Figure 7:
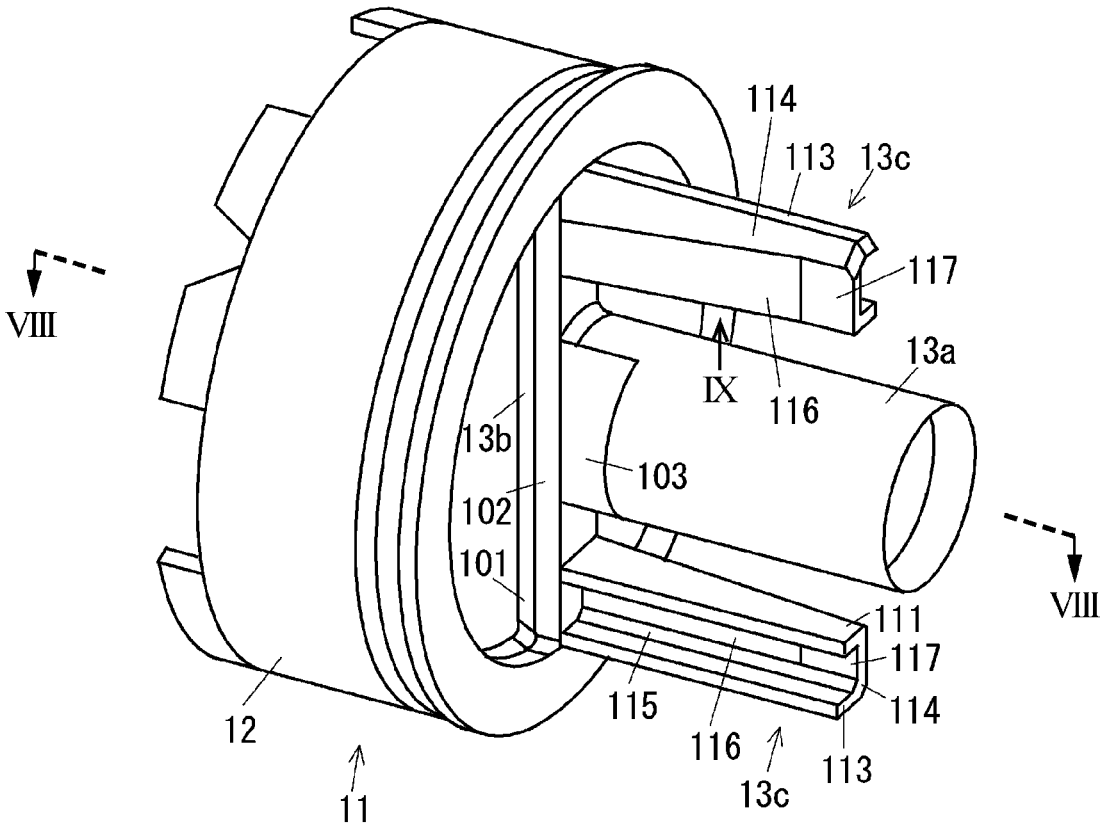
FIG. 7 illustrates a fin member according to the first example.

FIG. 7 illustrates a fin member according to the first example.

Referring to FIGS. 5A to 7, a fin member 11 is disposed behind the bottle 1. The fin member 11 exemplifies a crumbling device. The fin member 11 includes a cylindrical portion 12 in a front part and a fin body 13 on a rear part. The cylindrical portion 12 has a screw portion 12*a* in its inner circumferential surface. The screw portion 12*a* exemplifies a fastening portion. The screw portion 12*a* corresponds to the screw portion 4*a*. Accordingly, the screw portion 12*a* and the screw portion 4*a* are engaged with each other, thereby the fin member 11 and the bottle 1 are fastened and secured to each other. Thus, a rotating unit 1+11 according to the first example includes the fin member 11 and the bottle 1. The rotating unit 1+11 exemplifies a containing device.

Furthermore, a ring-shaped groove 12*b* is formed at a rear part of an outer circumference of the cylindrical portion 12. The groove 12*b* exemplifies a portion to be supported. A projecting ring 12*c* is formed behind the groove 12*b*. The projecting ring 12*c* exemplifies a first portion to be regulated. An outer diameter of the projecting ring 12*c* is larger than an outer diameter of the groove 12*b*.

Figure 8:
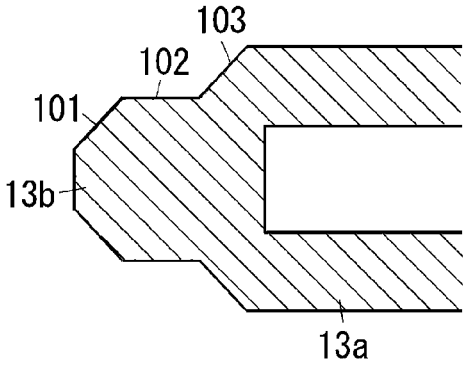
FIG. 8 is a sectional view taken along line VIII-VIII illustrated in FIG. 7.

FIG. 8 is a sectional view taken along line VIII-VIII illustrated in FIG. 7.

Referring to FIG. 7, the fin body 13 according to the first example has a shaft portion 13*a* that exemplifies a driven support member. The shaft portion 13*a* according to the example has a cylindrical shape extending in the front-rear direction. Bridge portions 13*b* that extend outward in the radial direction are formed at a front end of the shaft portion 13*a*. The bridge portions 13*b* each exemplify a beam portion and a connecting portion. An outer end of the bridge portions 13*b* are connected to the inner circumferential surface of the cylindrical portion 12. Two bridge portions 13*b* are provided according to the first example so as to be space from each other by 180 degrees in the circumferential direction of the bottle 1. That is, the bridge portions 13*b* have a bar shape that passes through the center of the cylindrical portion 12.

Referring to FIGS. 7 and 8, the bridge portions 13*b* according to the first example have beam inclined surfaces 101 and beam flat surfaces 102 at a front end portion thereof. The beam inclined surfaces 101 (exemplifying a third inclined surface) are each radially outwardly inclined toward the rear. The beam flat surfaces 102 each extend rearward from the rear end of the beam inclined surface 101 (without being inclined in the radial direction). The shaft portion 13*a* also has shaft inclined surfaces 103 (each of the shaft inclined surfaces 103 exemplifies a second inclined surface). The shaft inclined surfaces 103 are connected to the rear ends of the beam flat surfaces 102 and radially outwardly inclined toward the rear.

Figure 9:
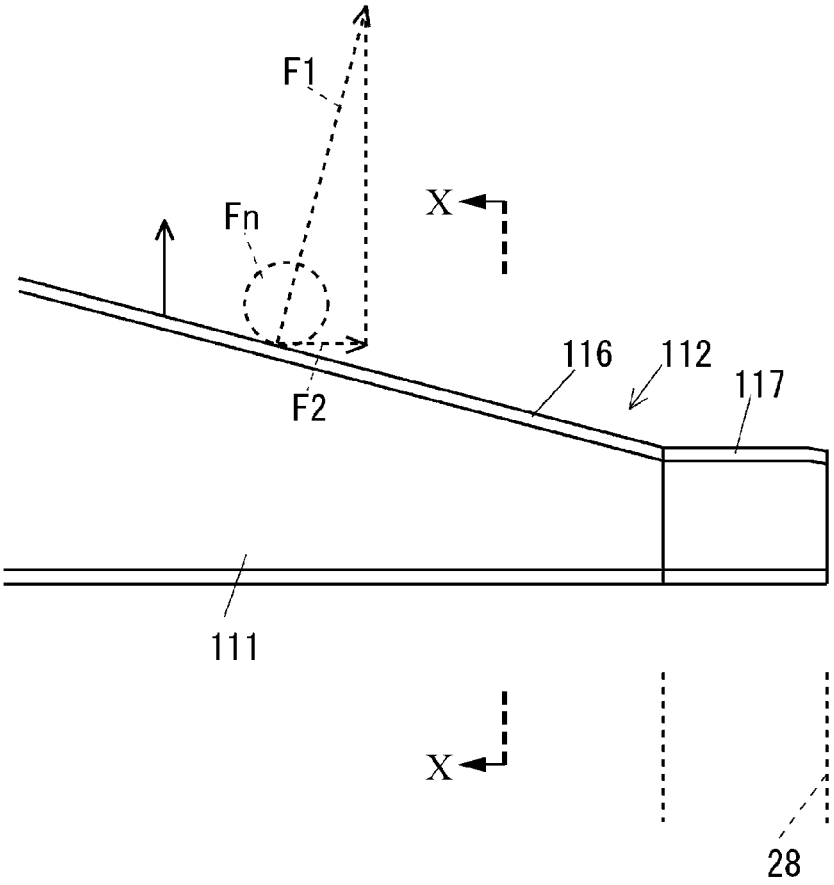
FIG. 9 is a view seen in an arrow IX direction illustrated in FIG. 7.

FIG. 9 is a view seen in an arrow IX direction illustrated in FIG. 7.

Figure 10:
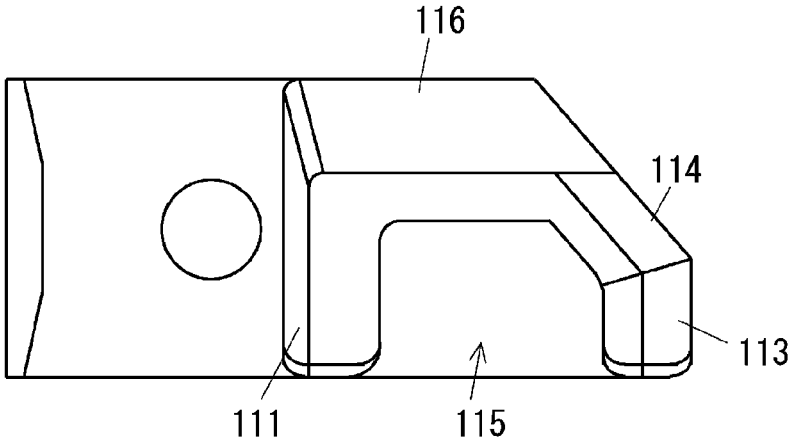
FIG. 10 is a sectional view taken along line X-X illustrated in FIG. 9.

FIG. 10 is a sectional view taken along line X-X illustrated in FIG. 9.

Referring to FIGS. 5A, 5B, and 7, paddles 13*c* are formed in the radially outer end portions of the bridge portions 13*b*. The paddles 13*c* each exemplify an applying member. Each of the paddles 13*c* according to the first example extends rearward from portions where the paddles 13*c* and are connected to the bridge portions 13*b*.

Referring to FIGS. 7, 9, and 10, the paddles 13*c* according to the first example each have an inner side surface 111 disposed on the radially inner side, a paddle surface 112 (exemplifying an applying member body) disposed on a downstream side in the rotating direction, and an outer side surface 113 disposed on the radially outer side. Referring to FIGS. 7 and 10, an inclined bevel portion 114 is formed between the paddle surface 112 and the outer side surface 113. Thus, the paddle 13*c* according to the first example has nothing on an upstream side in the rotating direction. In other words, the paddle 13*c* has a hollow on the upstream side in the rotating direction. Thus, the paddle 13*c* according to the first example has a space 115 extending in the front-rear direction. The space 115 exemplifies a hollow portion.

The paddle surface 112 according to the first example has a paddle inclined surface 116 inclined upstream in the rotating direction toward the rear (distal end; downstream in the direction in which the developer is transported). The paddle inclined surface 116 exemplifies a first inclined surface. Furthermore, a paddle flat surface 117 extending rearward in the axial direction (without being inclined in the rotating direction) is provided at a rear end portion of the paddle inclined surface 116 (downstream end portion in the developer transport direction). The paddle flat surface 117 exemplifies a transport reducing member.

The paddle flat surface 117 is disposed at a position corresponding to an outlet 28, which will be described later, in the front-rear direction in the paddle 13*c* according to the first example.

A coupling 16 is supported by the shaft portion 13*a*. The coupling 16 exemplifies a driven member. When the toner cartridge Ky, Km, Kc, Kk is mounted in the developer replenishment device U3*b*, the coupling 16 is engaged with a coupling supported by the developer replenishment device U3*b*, thereby transmitting drive.

Referring to FIGS. 4A, 4B, 5A, and 5B, a toner seal 17 is supported at a rear end surface of the cylindrical portion 12. The toner seal 17 exemplifies a leakage suppressing member. The toner seal 17 has a so-called ring shape, that is, an annular shape along the rear end portion of the cylindrical portion 12. The toner seal 17 is formed of any material that is able to suppress leakage of the developer. For example, an elastic member such as an elastomer or a foamed member such as a sponge is usable.

A flange portion 21 is supported at a rear part compared to the fin member 11. The flange portion 21 exemplifies a support member and a securing portion. The flange portion 21 has a cylindrical structure. The flange portion 21 exemplifying a cylindrical portion has a cylindrical front portion 22 and a cylindrical rear portion 24 having a smaller diameter than that of the front portion 22. When the toner cartridge Ky, Km, Kc, Kk is mounted in the developer replenishment device U3*b*, the flange portion 21 is secured to the developer replenishment device U3*b* at a position such that a receiving port provided in the developer replenishment device U3*b* corresponds to the outlet 28.

The front portion 22 has such an inner diameter that the front portion 22 covers an outer circumference of a rear part of the rotating unit 1+11. Furthermore, the front portion 22 has a cylindrical shape coaxial with the rotating unit 1+11. The front portion 22 has claw portions 22*a*. The claw portions 22*a* each exemplify a support member and a coupling portion. T claw portions 22*a* are disposed at positions corresponding to the ring-shaped groove 12*b*. Four claw portions 22*a* are spaced from one another by 90 degrees in a circumferential direction of the flange portion 21. Furthermore, a distal end of each of the claw portions 22*a* extends inward in the radial direction. The claw portions 22*a* are in contact with the side surface of the groove 12*b*, thereby regulating forward moving of the rotating unit 1+11 relative to the flange portion 21, that is, moving of the rotating unit 1+11 in the direction in which the rotating unit 1+11 is moved out from the flange portion 21. Thus, the claw portions 22*a* support the rotating unit 1+11 such that the rotating unit 1+11 is rotatable relative to the flange portion 21.

The claw portions 22*a* according to the first example has a so-called snap-fitting structure. Accordingly, in mounting the rotating unit 1+11 to the flange portion 21, when the projecting ring 12*c* passes through the position of the claw portions 22*a*, the claw portions 22*a* are elastically deformed so as to allow the projecting ring 12*c* to move beyond the claw portions 22*a*. Then, when the groove 12*b* reaches the position of the claw portions 22*a*, the claw portions 22*a* are elastically returned to their original shape, thereby being brought into contact with the groove 12*b*.

A ring-shaped projection 23 is formed at a front end of the front portion 22. The projection 23 exemplifies a compressing portion. The projection 23 is disposed so as to correspond to the position of the toner seal 17. Thus, when the flange portion 21 and the rotating unit 1+11 are coupled with each other, the projection 23 compresses the toner seal 17, so that the toner seal 17 is supported in a state in which the toner seal 17 is compressed.

Referring to FIGS. 5A and 5B, a plate-shaped wall portion 26 that extends in the up-down direction and the left-right direction is formed at a boundary portion between the front portion 22 and the rear portion 24. According to the first example, the developer exists in a space surrounded by the front portion 22 and the wall portion 26. The coupling 16 penetrating through the wall portion 26 is rotatably supported by the wall portion 26.

A discharge path 27 extending downward is formed below the wall portion 26. The outlet 28 is formed at a lower end of the discharge path 27. The outlet 28 is connected to the developer replenishment device U3*b*. The developer replenishment device U3*b* exemplifies a member to which the outlet is connected.

A shutter 29 is supported on the lower side of the discharge path 27 such that the shutter 29 is movable in the front-rear direction. The shutter 29 exemplifies an opening/closing member. The shutter 29 moves between an open position and a closed position. The shutter 29 opens the outlet 28 at the open position and closes the outlet 28 at the closed position as the toner cartridge Ky, Km, Kc, Kk is inserted and removed. Any of various known related-art structures may be adopted for the structure for moving the shutter 29 as the toner cartridge Ky, Km, Kc, Kk is inserted and removed. Thus, the detailed description of the structure for moving the shutter 29 is omitted.

Referring to FIGS. 3, 4A, and 4B, insertion guides 31 are formed on an outer circumferential surface of the rear portion 24. The insertion guides 31 each serve as a portion to be guided. When mounting the toner cartridge Ky, Km, Kc, Kk, the insertion guides 31 are guided by guiding portions (not illustrated) provided in the image forming system U3. The image forming system U3 exemplifies an image forming apparatus body.

Furthermore, a mechanical key 32 is disposed on an upper portion of the rear portion 24. The mechanical key 32 exemplifies an identification portion. The mechanical key has a plurality of projections extending in the front-rear direction. The number and the positions of the projections of the mechanical key vary depending on the color of the toner cartridge Ky, Km, Kc, Kk.

Operation of the First Example

In the copier U according to the first example having the above-described structure, when drive is transmitted to the coupling 16 in accordance with consumption of the toner with the toner cartridge Ky, Km, Kc, Kk mounted in the developer replenishment device U3*b*, the fin member 11 and the bottle 1 are rotated. When the bottle 1 is rotated, the developer is transported rearward along the helical groove portion 2. The developer replenishment device U3*b* is replenished, through the outlet 28, with the developer transported rearward along with the rotation of the bottle 1.

Here, the groove 2 is formed down to the rear end of the bottle 1. Thus, the developer is unable to be subjected to a transport force in the groove 2 at a region downstream of the groove 2. Thus, as is the case with the structure described in Japanese Unexamined Patent Application Publication No. 2008-164663, 10-171230, or 2011-150121, according to the related art, a guide portion having an inclined surface shape, a helical rib, or a member that transports the developer such as a suction pump is separately provided between the downstream end of the bottle to the outlet. However, with the structure to which a separate transport member is added, the structure may become complex. This may in turn increase the number of components and the cost.

With the structure as described in Japanese Unexamined Patent Application Publication No. 2008-164663, 10-171230, or 2011-150121, in which a separate transport member is not provided, the developer existing between the downstream end of the bottle to the outlet is pushed by the developer flowing in from an upstream side and, thereby being fed downstream. However, with such a structure, when the total amount of the developer is reduced, the amount of the developer flowing in is reduced. This may increase the amount of the developer that does not reach the outlet 28. Thus, there may be a situation in which the developer is not completely used.

In order to address these, in each of the toner cartridges Ky, Km, Kc, Kk according to the first example, the paddle inclined surface 116 is formed in each of the paddles 13*c* of the fin member 11. Referring to FIG. 9, when the fin member 11 is rotated, each of the paddles 13*c* itself is moved in the circumferential direction. However, developer Tn in contact with the paddle inclined surface 116 is subjected to a force F1 in the direction of the normal to the paddle inclined surface 116. Thus, the force F1 in the direction of the normal applies to the developer Tn a force component F2 directed toward the outlet 28 in accordance with an inclination angle of the paddle inclined surface 116. Accordingly, even with the fin member 11 where no groove 2 is formed, the developer is able to be transported. Furthermore, unlike Japanese Unexamined Patent Application Publication No. 2008-164663, 10-171230, or 2011-150121, according to the first example, it is sufficient that the shape of the paddles 13*c* be changed, and addition of a separate member is not required. As a result, compared to the related-art, complication of the structure may be suppressed, and accordingly, the increase in the number of components or the cost may be suppressed.

According to the first example, an angle of the paddle inclined surface 116 relative to the horizontal is set to be 5 degrees. As this angle increases, the transport force increases. However, this also increases a force from the developer to which the paddle 13*c* is subjected. Thus, it is required that the paddle 13*c* have strength. Accordingly, the angle of the paddle inclined surface 116 is able to be set or changed to an angle in accordance with a required transport amount, liquidity of the developer, and so forth.

Furthermore, in each of the toner cartridges Ky, Km, Kc, Kk according to the first example, the paddle flat surface 117 is formed at the downstream end portion of each of the paddles 13*c*. Thus, in a region at the paddle flat surface 117, a force to transport the developer downstream is not applied to the developer.

With a structure where no paddle flat surface 117 is formed, the developer is subjected to the force to transport the developer downstream even in a portion at the outlet 28. This causes the developer that has not flowed out through the outlet 28 to be pushed downstream. The developer pushed further downstream (rear) than the outlet 28 is pushed into a gap between the shaft portion 13*a* and the coupling 16. This may cause the developer to be compacted, waste the developer because of not using the developer for developing, or cause the developer to leak through the gap. Leakage of the developer through the gap may in turn cause the inside of the copier U to be smeared with the developer or lead to failure in a drive system.

In contrast, the paddle flat surfaces 117 are provided at regions corresponding to a region near the outlet 28 according to the first example. Thus, the developer is unlikely to be pushed. Accordingly, leakage of the developer or compacting the developer on a downstream side may be suppressed.

Furthermore, in each of the toner cartridges Ky, Km, Kc, Kk, the paddles 13*c* have the respective hollow space 115. Thus, compared to the case where the spaces 115 are not formed, the total amount of the toner able to be contained in the toner cartridge Ky, Km, Kc, Kk may increase. Furthermore, the spaces 115 according to the first example are formed on the downstream side in the rotating direction of the fin member 11. Thus, the spaces 115 do not necessarily adversely affect the performance of the paddles 13*c* for crumbling the developer. Furthermore, the weight of the fin member 11 may be reduced.

Furthermore, the paddles 13*c* each have the bevel portion 114. Thus, when the paddle 13*c* is rotated, a space is formed between the bevel portion 114 and the inner wall surface of the flange portion 21. This reduces, when the developer is pushed by the paddle inclined surface 116, a pressure applied to the developer existing in the radially outer side. Accordingly, the occurrences of a situation in which the developer is rubbed against the inner wall surface of the flange portion 21 may be reduced, and degradation of the developer due to pressure (stress) applied to the developer may be suppressed.

Furthermore, according to the first example, the beam inclined surface 101 is formed in a region of each of the bridge portions 13*b* on the upstream side. The beam inclined surface 101 is not formed in the related-art structure. Instead, the beam inclined surface 101 has a square rod shape. Thus, with the related-art structure, the bridge portion resists the transport of the developer flowing from the bottle to fin portion. In contrast, according to the first example, the developer may be smoothly guided through the beam inclined surface 101. This may reduce the likelihood of inhibition of transportation of the developer.

Also, the shaft inclined surfaces 103 are formed in the shaft portion 13*a* according to the first example. With the related-art structure without the shaft inclined surfaces 103, step shapes are formed between the bridge portions and the shaft portion, and these step portions resist the transport. In contrast, according to the first example, the developer may be smoothly guided through the shaft inclined surfaces 103. This may reduce the likelihood of inhibition of transportation of the developer.

Another Form

Figure 11:
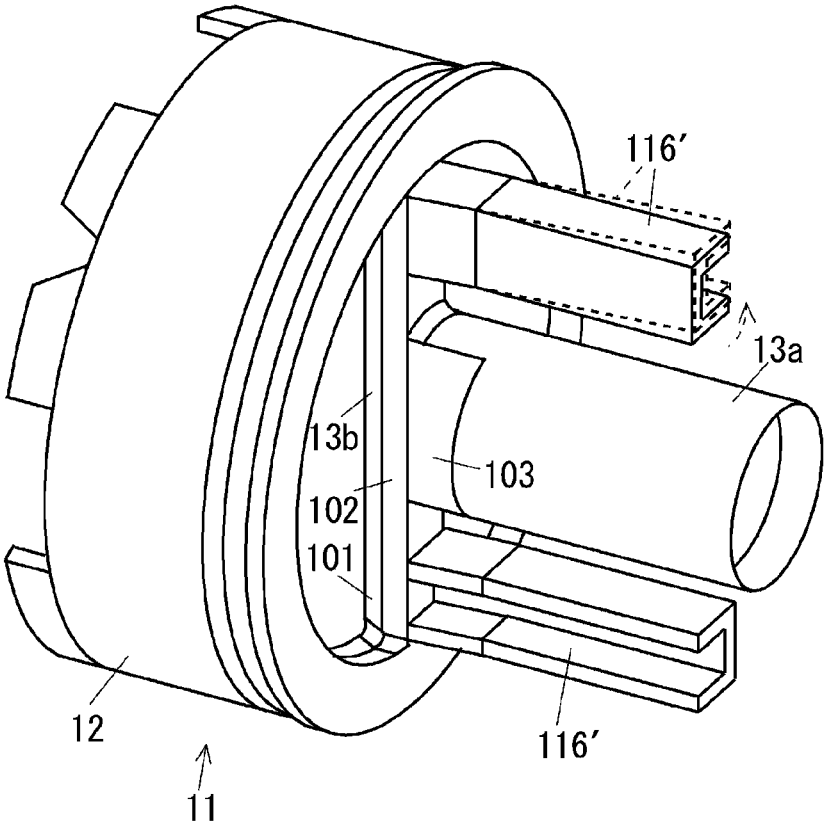
FIG. 11 illustrates another form of the example.

FIG. 11 illustrates another form of the example.

Although the applying member applying the transport force for the developer is exemplified by the case where the paddle inclined surface 116 is formed in each of the paddles 13*c* according to the first example, this is not limiting. As illustrated in FIG. 11, distal end portions of the paddles 13*c* are able to include respective rubber rods 116'. The rubber rod 116' exemplifies the applying member. The rubber rods 116' are each formed by a bar-shaped elastic member. Furthermore, the rubber rod 116' is supported such that the rubber rod 116' extends in the axial direction of the toner cartridge Ky, Km, Kc, Kk in a natural length state.

When the fin member 11 is rotated, the rubber rod 116' is also rotated and, by a pressure applied from the developer, elastically deformed such that the rubber rod 116' is inclined relative to the axial direction. Thus, with the inclined surface of the rubber rod 116', a transport force is applied to the developer. Accordingly, an operating feature similar to that of the first example may be obtained with the form illustrated in FIG. 11.

Variations

Although the example of the present disclosure has been described in detail, the present disclosure is not limited to the above-described example. Many variations are possible without departing from the gist of the present disclosure described in the claims. Variations (H01 to H05) of the present disclosure are exemplified as follows.

(H01) Although the structure of the copier U exemplifies the image forming apparatus according to the above-described example, this is not limiting. The image forming apparatus may be applied to a facsimile machine, a multifunction machine that includes a plurality of these functions, or the like. Furthermore, the image forming apparatus is not limited to an image forming apparatus for multi-color developing. The image forming apparatus may be an image forming apparatus for single color printing, that is, a so-called monochrome image forming apparatus. The image forming apparatus is not limited to an image forming apparatus of a tandem type. The image forming apparatus may be applied to an image forming apparatus of a rotary type or the like.

(H02) The shapes and the numbers of the bridge portions 13*b* and the paddles 13*c* according to the example are not limited to those exemplified. The shapes of the bridge portions 13*b* and the paddles 13*c* are able to be changed and the numbers of the bridge portions 13*b* and the paddles 13*c* are able to be increased or reduced in accordance with the design or specification. When the numbers are increased, the volume occupied by the paddles 13*c* is increased in a space inside the flange portion 21 where the developer is transported, thereby reducing the amount of the developer able to be transported. Thus, the numbers may be set in accordance with required performance for crumbling the developer or required transport performance.

(H03) According to the example, the paddle flat surfaces 117 may be provided. However, it is possible to omit the paddle flat surfaces 117. Furthermore, although the bevel portions 114 and the spaces 115 being a hollow may be formed, it is possible to omit the bevel portions 114 or the spaces 115.

(H04) Although the beam inclined surfaces 101 and the shaft inclined surfaces 103 may be provided according to the example, it is possible to omit the beam inclined surfaces 101 or the shaft inclined surfaces 103.

(H05) Although each of the paddle flat surfaces 117 extending in the horizontal direction exemplifies the transport reducing member according to the example, this is not limiting. Instead of extending in the horizontal direction, the paddle flat surface 117 is able to be a reverse inclined surface that inclined in the opposite direction to the paddle inclined surface 116 or a mildly inclined surface inclined relative to the horizontal by a smaller inclination angle than an inclination angle by which the paddle inclined surface 116 is inclined relative to the horizontal.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A developer container comprising:

a containing device that contains developer therein and that is rotated so as to transport the developer;

a support member that supports the containing device such that the containing device is rotatable and that has an outlet through which the developer transported by the containing device flows out; and a crumbling device that is supported such that the crumbling device is rotatable together with the containing device, that is, when the containing device is rotated, rotated so as to crumble the developer, and that includes a body portion that extends from a region near the containing device toward the outlet, and an applying member that is formed in the body portion and that applies a force for transporting the developer toward the outlet when the crumbling device is rotated.

2. The developer container according to claim 1, wherein the applying member includes an inclined surface that is, toward a downstream side in a direction in which the developer is transported, inclined upstream in a direction in which the crumbling device is rotated.

3. The developer container according to claim 2, wherein a hollow portion is formed upstream of the inclined surface in the crumbling device rotating direction.

4. The developer container according to claim 1, wherein the applying member has a downstream end portion in a direction in which the developer is transported, and wherein the developer container further includes a transport reducing member that is provided at the downstream end portion of the applying member and that reduces a developer transport capability compared to a developer transport capability applied by the applying member.

5. The developer container according to claim 4, wherein the containing device includes a rotating shaft, and wherein the transport reducing member includes a surface extending in an axial direction of the rotating shaft.

6. The developer container according to claim 1, further comprising:

a beam portion that supports one end of the body portion and that extends in a radial direction of the containing device;

a driven support member that has an end portion near the beam portion, that is supported by the beam portion, and that supports a driven member to which drive is transmitted; and a second inclined surface that is formed at the end portion of the driven support member and that is inclined outward in a radial direction toward a downstream side in a direction in which the developer is transported.

7. The developer container according to claim 6, further comprising:

a third inclined surface that is provided in the beam portion and that is inclined outward in the radial direction toward the downstream side in the developer transport direction.

8. An image forming apparatus comprising:

an image holding device on which a latent image is formed;

a developing unit that develops the latent image on the image holding device;

a transfer system that transfers the developed image on the image holding device to a medium;

a fixing unit that fixes the image transferred to the medium; and the developer container according to claim 1 that contains the developer with which the developing unit is replenished.

9. A developer container comprising:

means for containing that contains developer therein and that is rotated so as to transport the developer;

means for supporting that supports the means for containing such that the means for containing is rotatable and that has an outlet through which the developer transported by the means for containing flows out; and means for crumbling that is supported such that the means for crumbling is rotatable together with the means for containing, that is, when the means for containing is rotated, rotated so as to crumble the developer, and that includes a body portion that extends from a region near the means for containing toward the outlet, and means for applying that is formed in the body portion and that applies a force for transporting the developer toward the outlet when the means for crumbling is rotated.

* * * * *